US008715010B2

(12) United States Patent
Wang et al.

(10) Patent No.: US 8,715,010 B2
(45) Date of Patent: May 6, 2014

(54) ELECTRIC CONNECTOR WITH MULTI-TRANSMISSION INTERFACES

(75) Inventors: Ching-Shun Wang, Taipei (TW); Chia-Ho Chang, Taipei (TW); Yuan-Bin Tang, Taipei (TW)

(73) Assignee: Advanced Connection Technology, Inc., New Taipei (TW)

( * ) Notice: Subject to any disclaimer, the term of this patent is extended or adjusted under 35 U.S.C. 154(b) by 36 days.

(21) Appl. No.: 13/549,855

(22) Filed: Jul. 16, 2012

(65) Prior Publication Data

US 2013/0189880 A1 Jul. 25, 2013

(30) Foreign Application Priority Data

Jan. 19, 2012 (TW) ..... 101102148 A
Jan. 19, 2012 (TW) ..... 101201300 U
Feb. 17, 2012 (TW) ..... 101202997 U
Mar. 9, 2012 (TW) ..... 101204317 U

(51) Int. Cl.
*H01R 24/00* (2011.01)

(52) U.S. Cl.
USPC ..... 439/660

(58) Field of Classification Search
USPC ..... 439/660, 607.01, 79, 541.5, 639
See application file for complete search history.

(56) References Cited

U.S. PATENT DOCUMENTS

D410,629 S * 6/1999 Bandura et al. ..... D13/147
6,758,685 B1 * 7/2004 Huang et al. ..... 439/79
7,988,495 B2 * 8/2011 Chung ..... 439/660
8,172,585 B2 * 5/2012 Chiu et al. ..... 439/108
8,308,515 B2 * 11/2012 Chang ..... 439/660
2009/0042448 A1 * 2/2009 He et al. ..... 439/650
2009/0186528 A1 * 7/2009 Chen ..... 439/660
2010/0173529 A1 * 7/2010 He et al. ..... 439/660
2011/0059656 A1 * 3/2011 Tsai ..... 439/660
2011/0124234 A1 * 5/2011 Chung ..... 439/660
2012/0077390 A1 * 3/2012 Tsai ..... 439/660
2013/0035001 A1 * 2/2013 Yen et al. ..... 439/660
2013/0059479 A1 * 3/2013 Ho ..... 439/639

FOREIGN PATENT DOCUMENTS

JP 03162616 U 9/2010
JP 03171249 U 10/2011
KR 2020100004044U A 4/2010
KR 1020100114471 A 10/2010

* cited by examiner

*Primary Examiner* — Alexander Gilman
(74) *Attorney, Agent, or Firm* — Muncy, Geissler, Olds & Lowe, P.C.

(57) ABSTRACT

An electric connector includes a main body, a plurality of first terminals, a plurality of second terminals, and a plurality of third terminals. The main body includes a socket, a base, and a tongue. The base is disposed in the socket. The tongue includes a first tongue portion and a second tongue portion. The first tongue portion has a first thickness, and the second tongue portion has a second thickness different from the first thickness. The first terminals are disposed on the first tongue portion for transmitting a first signal meeting the first standard. The second terminals and the third terminals are respectively disposed on the two surface of the second tongue portion for transmitting a second signal meeting the second standard.

9 Claims, 13 Drawing Sheets

ELECTRIC CONNECTOR WITH MULTI-TRANSMISSION INTERFACES

CROSS-REFERENCES TO RELATED APPLICATIONS

This non-provisional application claims priority under 35 U.S.C. §119(a) on Patent Application No. 101201300, 101102148, 101202997, and 101204317 filed in Taiwan, R.O.C. on Jan. 19, 2012, Jan. 19, 2012, Feb. 17, 2012, and Mar. 9, 2012 the entire contents of which are hereby incorporated by reference.

BACKGROUND

1. Technical Field

The disclosure relates to an electric connector and in particular to an electric connector having multi-transmission interfaces.

2. Related Art

Electric devices are widely used by modern consumers. The dimension requirements of electric devices trend increasingly towards low weight and small size. As a result, the volume of the electric connector disposed in the electric devices must be reduced, especially for those which must be installed with several electric connectors meeting different kinds of signal transmitting standard respectively, so as to be capable of connecting with different kinds of connector plugs. Because each electric connector occupies a certain volume as well as requiring room to remain separate from one to each other, a waste in space results.

For instance, if the electric devices for providing digital media information are installed with a HDMI (High-Definition Multimedia Interface) socket connector, USB (Universal Serial Bus) socket connector, earphone socket connector, and microphone socket connector individually, considerable space is wasted by installing each of these socket connectors.

There is therefore a need for the technicians in the art to integrate several electric connectors, such as HDMI connectors and USB connectors, to save space occupied by electric connectors. Meanwhile, a tamper resistant design must be considered as well.

SUMMARY

Accordingly, an electric connector including a main body, a plurality of first socket terminals, a plurality of second socket terminals, and a plurality of third socket terminals is provided. The main body includes a socket, a base, and a tongue. The base is disposed at the socket. The tongue which includes a first tongue portion and a second tongue portion is disposed in the socket. The first tongue portion has a first thickness, and the second tongue portion has a second thickness different from the first thickness. The first socket terminals are disposed at one side of the first tongue portion and used to transmit a first signal meeting a first standard. The second socket terminals are disposed at a first surface of the second tongue portion. The third socket terminals are disposed at a second surface of the second tongue portion. The second socket terminals and the third socket terminals transmit a second signal meeting a second standard.

An electric connector including a main body, a plurality of first socket terminals, a plurality of second socket terminals, and a plurality of third socket terminals is provided also. The main body includes a socket, a main body, and a tongue. The main body is disposed in the socket. The tongue including a first tongue portion and a second tongue portion is disposed in the socket. The first tongue portion has first thickness, and the second tongue portion has second thickness different from the first thickness. The first socket terminals are disposed at one side of the first tongue portion and transmit a first signal meeting a first standard. The second socket terminals are disposed at a first surface of the second tongue portion. The third socket terminals are disposed at a second surface of the second tongue portion. The second socket terminals and the third socket terminals transmit a second signal meeting a second standard. The first socket terminals and part of the third socket terminals transmit a third signal meeting a third standard.

It is to be understood that both the foregoing general description and the following detailed description presented below are intended to provide an overview or framework for understanding the nature and character of the disclosure as it is claimed. The accompanying drawings are included to provide a further understanding of the disclosure, and are incorporated into and constitute a part of this specification. The drawings illustrate various embodiments of the disclosure, and together with the description serve to explain the principles and operations of the disclosure.

DETAILED DESCRIPTION

Figure 1:
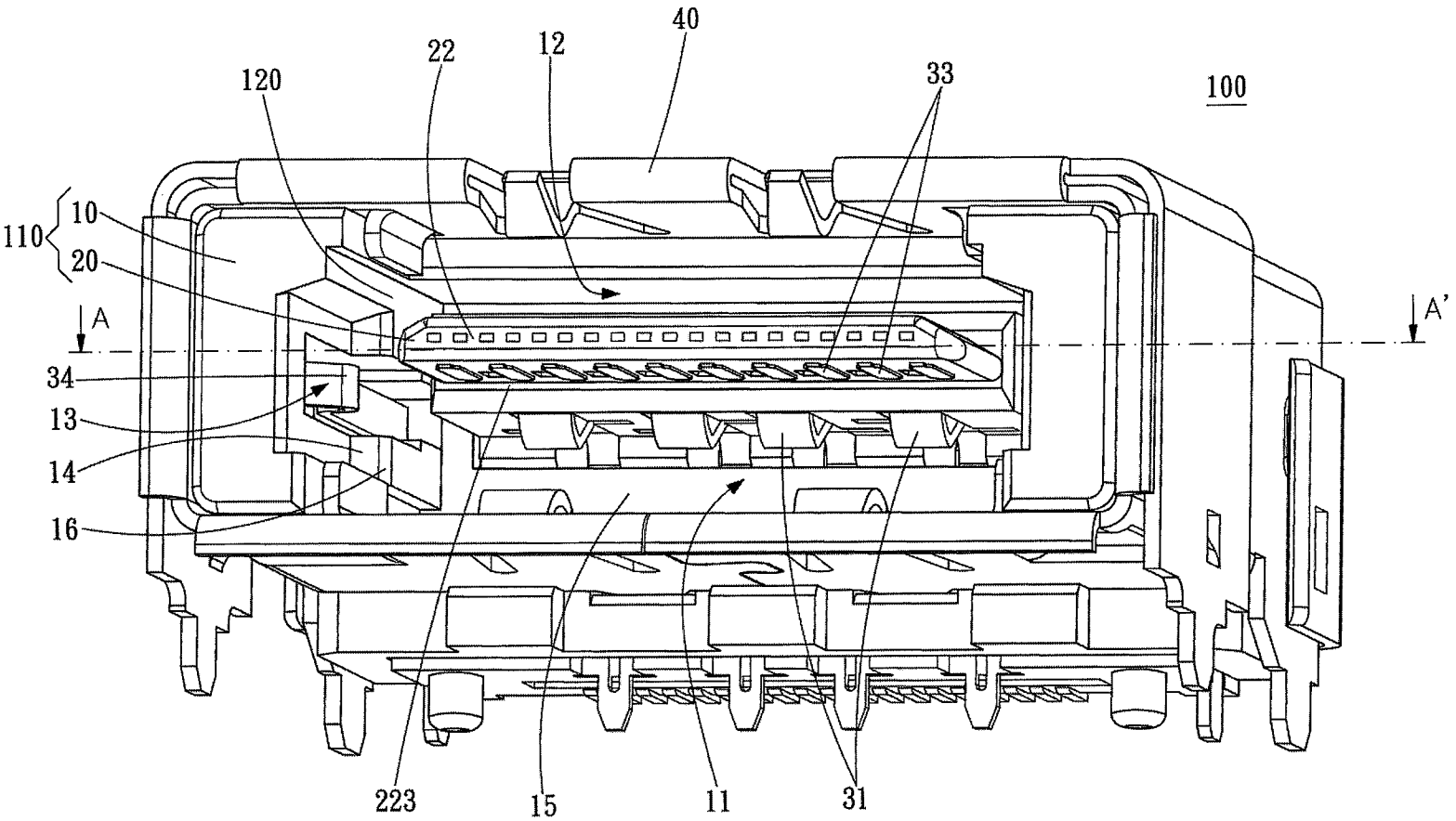
FIG. 1 is a schematic three-dimensional view of the first embodiment
Figure 2A:
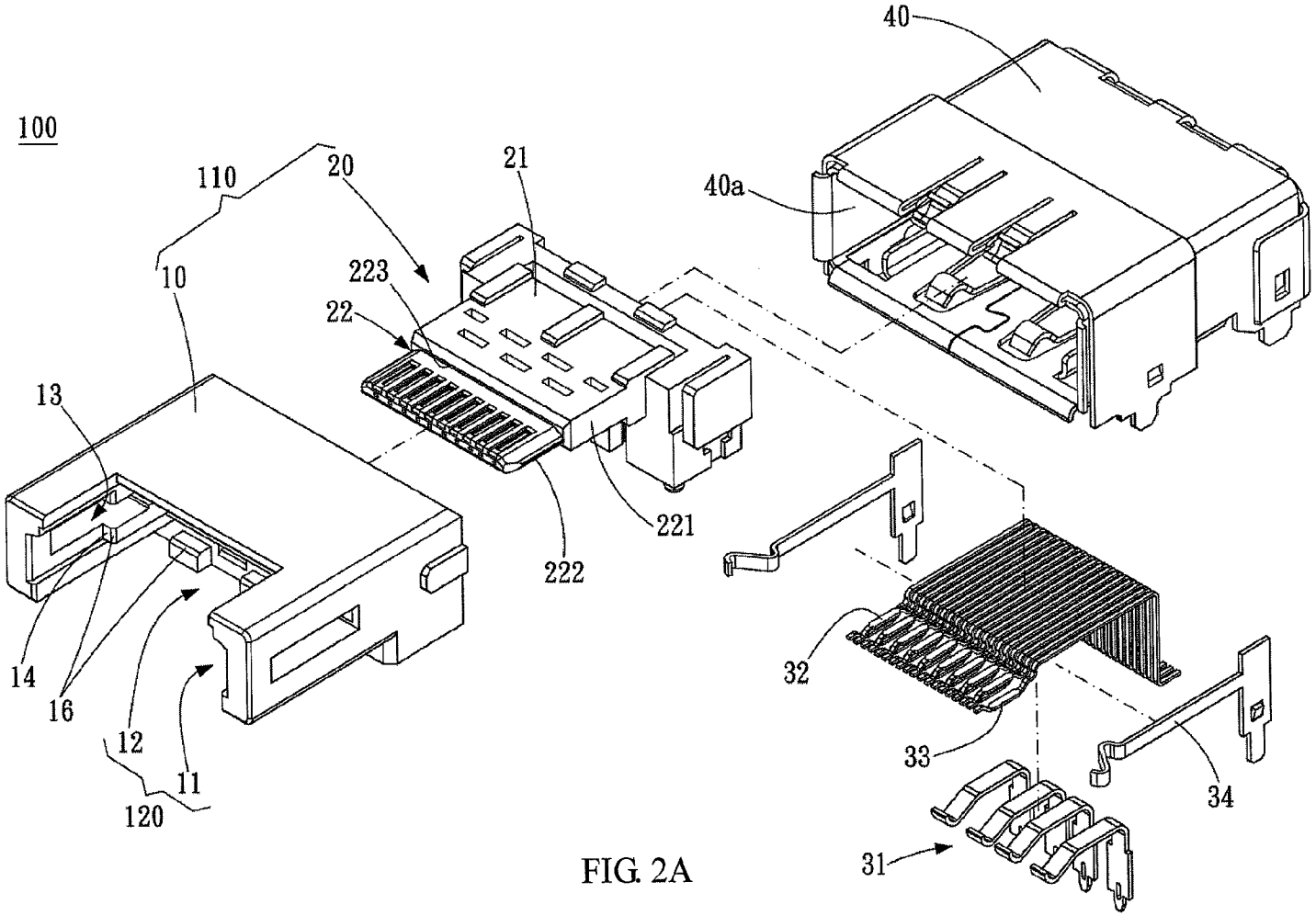
FIG. 2A is a schematic exploded view of the first embodiment.
Figure 2B:
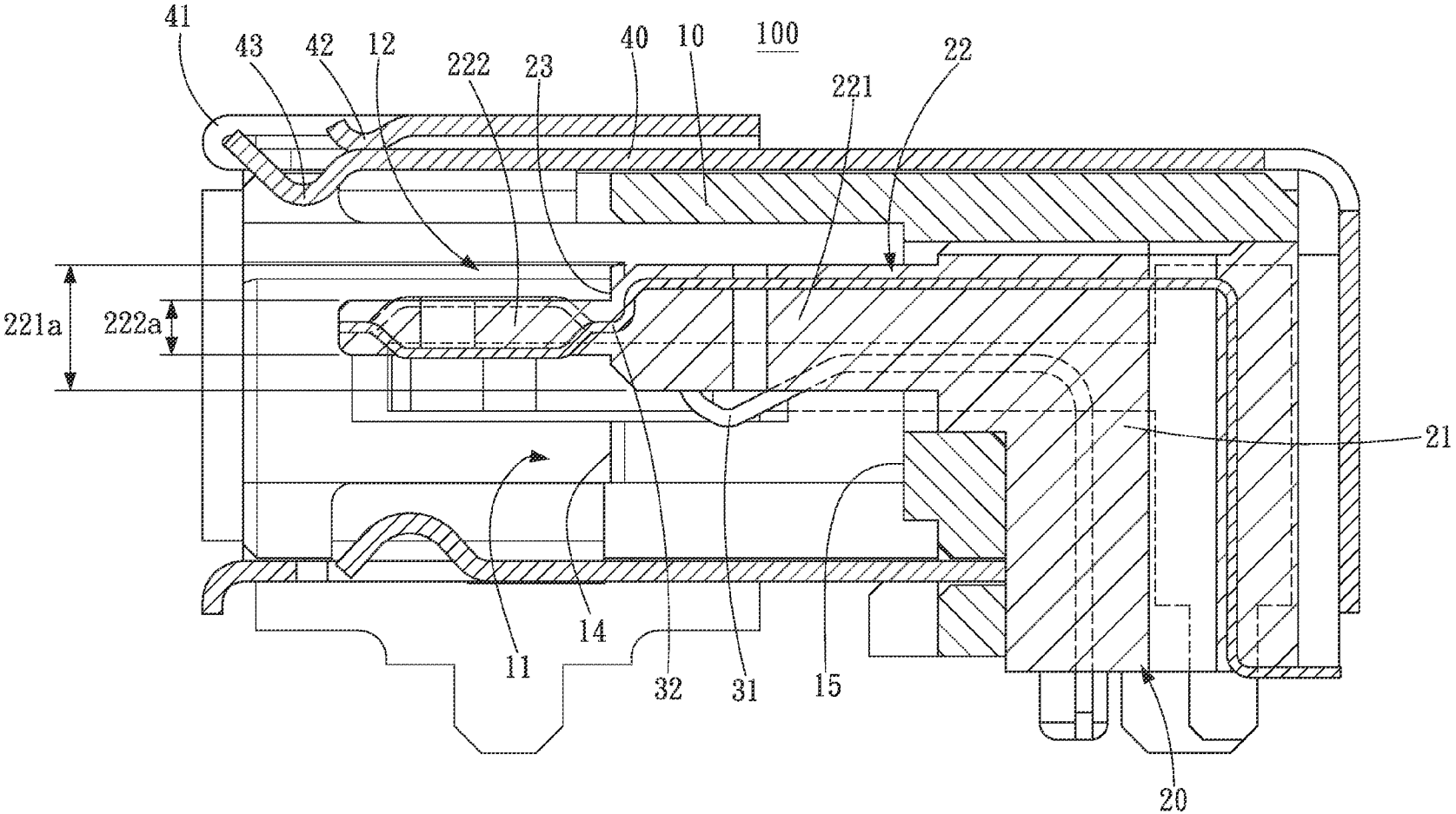
FIG. 2B is a schematic cross-sectional view of the first embodiment.

Please refer to FIG. 1, FIG. 2A, and FIG. 2B, which are a schematic three-dimensional view, exploded view, and cross-sectional view of the first embodiment respectively. According to the first embodiment, an electric connector socket 100 for connecting a first plug 200 meeting a first standard or a second connector plug 200 meeting a second standard is disclosed. The electric connector socket 100 of the embodiment is capable of being only inserted by a normal first connector plug meeting the first standard (ex. USB signal), as well as being only inserted by a normal second connector plug meeting the second standard (ex. HDMI signal). The electric connector socket 100 includes a main body 110, a plurality of first socket terminals 31, a plurality of second socket terminals 32, a plurality of third socket terminals 33, and a switch terminal 34.

Main body 110 in this embodiment includes a plastic frame base 10 and an insulating base 20, but not limited to it. Main body 110 includes a socket 120, a tongue 22, and an abutment area 13. Socket 120 in this embodiment is formed by plastic frame base 10, which is described in detail below. Tongue 22 is formed by insulating base 20. Abutment area 13 is disposed in socket 120. In this embodiment, abutment area 13 is located at the sidewall of plastic frame base 10. Tongue 22 includes first tongue portion 221 and second tongue portion 222. First tongue portion 221 has a first thickness 221*a*. Second tongue portion 222 has a second thickness 222*a* different from first thickness 221*a*. First tongue portion 221 and second tongue portion 222 are both disposed in socket 120 (as shown in FIG. 2B).

Plastic frame base 10 includes a first insert space 11 and a second insert space 12. In short, socket 120 is composed of first insert space 11 and second insert space 12. The shape of the inlet of socket 120 appears to be a reverse letter "T". First insert space 11 meets the first standard, and second insert space 12 meets the second standard. Further, the first standard is preferably the USB (Universal Serial Bus), and the second standard is preferably the HDMI (High-Definition Multimedia Interface). Additionally, the size of first insert space 11 of the first standard (USB) is smaller than second insert space 12 of the second standard (HDMI).

Main body 110 further includes a first abutment surface 14 and a second abutment surface 15 (as shown in FIG. 1). First abutment surface 14 is located at the inner wall of first insert space 11 in socket 120. As connector plug 200 meeting the first standard inserts into first insert space 11, first abutment surface 14 abuts against connector plug 200. Second abutment surface 15 is located at the inner wall of second insert space 12 in socket 120. As connector plug 200 meeting second standard inserts into second insert space 12, second abutment surface 15 abuts against connector plug 200. In addition, plastic frame base 10 includes guiding surfaces 171 (as shown in FIG. 2A), disposed inside. Guiding surfaces 171 are disposed in first insert space 11 and second insert space 12 individually. As connector plug 200 meeting the first standard or the second standard inserts into first insert space 11 and second insert space 12, guiding surfaces guide connector plug 200 to be positioned in a correct direction.

Figure 8:
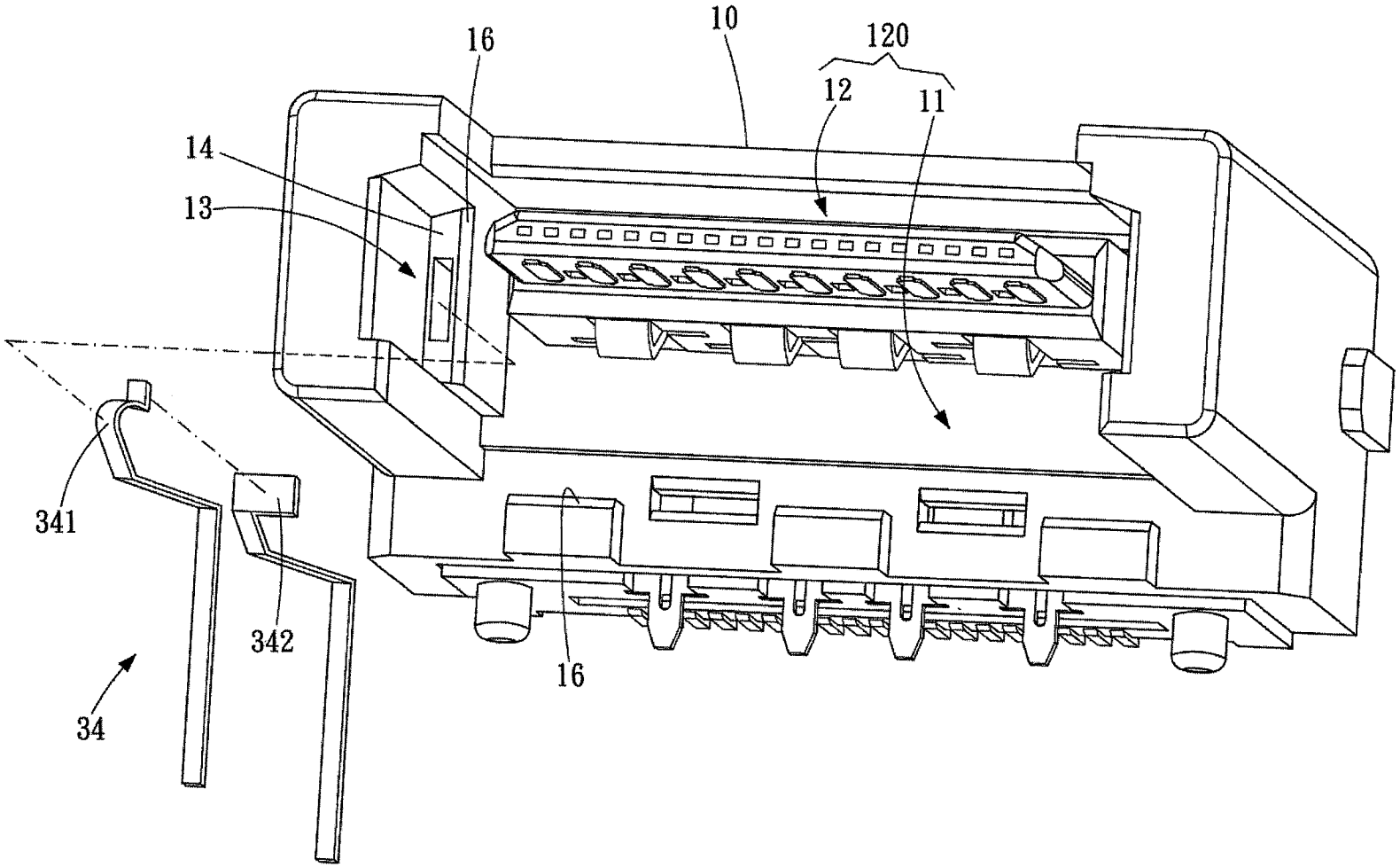
FIG. 8 is a schematic exploded view of the fourth embodiment.
Figure 9:
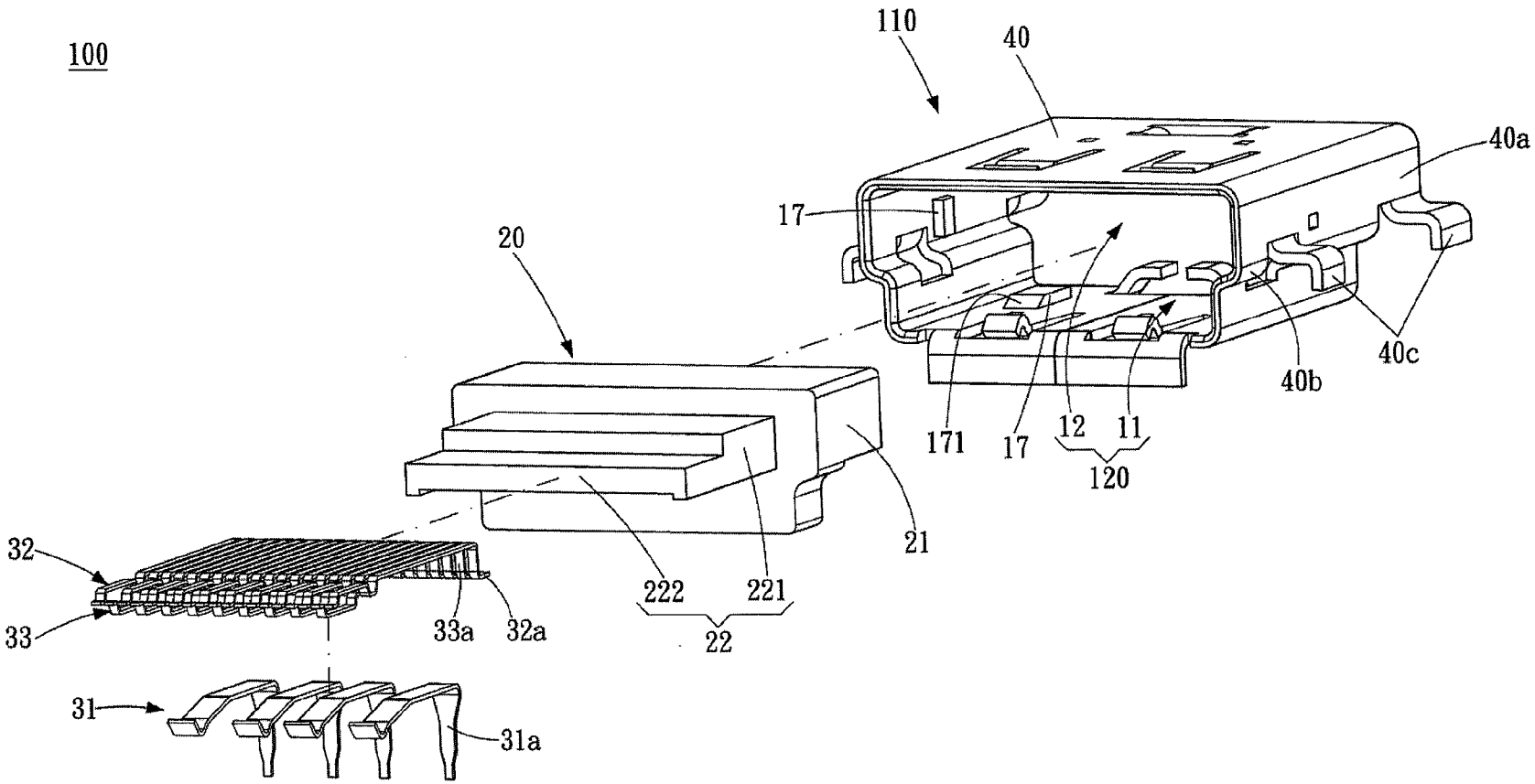
FIG. 9 is a schematic exploded view of the fifth embodiment.

Insulating base 20 is preferably made from a plastic insulating material. Insulating base 20 is disposed in plastic frame base 10. In this embodiment, insulating base 20 and plastic frame base 10 are different components and assembled together. In addition, insulating base 20 and plastic frame base 10 can be monolithically formed (as shown in FIG. 8). In this embodiment, insulating base includes base 21 and tongue 22. Preferably, tongue 22 is monolithically formed by an extension of one side of base 21. Tongue 22 includes first tongue portion 221 and second tongue portion 222 connecting with first tongue portion 221. First tongue portion 221 has first thickness 221*a* and connects to base 21. Second tongue portion 222 connects to first tongue portion 221 and has a second thickness 222*a* different from first thickness 221*a*. In this embodiment, first thickness 221*a* is larger than second thickness 222*a*.

In the case that one side of first tongue portion 221 is at the same level with one side of second tongue portion 222, an interval is formed between one end of first socket terminals 31 and one end of part of second socket terminals 32. First socket terminals 31. The distance between one end of first socket terminals 31 and one side of first tongue portion 221 is larger than the distance between one end of part of second socket terminals 32 and one side of second tongue portion 222. As connector plug 200 inserts into connector socket 100, the interval prevents first plug terminals 80 from contacting second socket terminals 32 as well as avoids an issue of signal-interference.

First socket terminals 31 are disposed at insulating base 20 and embedded in base 21 with one end. First socket terminals 31 preferably are combined with insulating base 20 by insert molding or in a separable manner. The other end of each of first socket terminals 31 is disposed at first tongue portion 221 and faces first insert space 11 so as to transmit the first signal meeting the first standard. It means that first socket terminals 31 transmit USB signals, and the other end of each of first socket terminals 31 disposed at first tongue 221 is exposed. It should be noted that the other end of each of first socket terminals 31 is capable of being disposed at the upper surface or bottom surface of first tongue portion 221.

Second socket terminals 32 are disposed at a first surface of second tongue portion 222. The first surface is opposite to the surface of first tongue portion 221 where first socket terminals 31 disposed at. One end of second socket terminals 32 faces first insert space 11 (or second insert space 12).

Third socket terminals 33 are disposed at a second surface of second tongue portion 222. The second surface and the surface (upper surface or bottom surface), of first tongue portion 221 where first socket terminals 31 disposed at are coplanar. One end of third socket terminals 33 is disposed at second tongue portion 222 and facing second insert space 12. Second socket terminals 32 and third socket terminals 33 transmit a second signal meeting the second standard. It means that second socket terminals 32 and third socket terminals 33 transmit an HDMI signal. One end of second socket terminals 32 and one end of third socket terminals 33 are interlacedly facing first insert space 11 or second insert space 12. Second socket terminals 32 and third socket terminals 33 are combined with insulating base 20 by insert molding or in a separable manner. The end of second socket terminals 32 and third socket terminals 33 disposed at second tongue portion 222 are preferably exposed.

Figure 6:
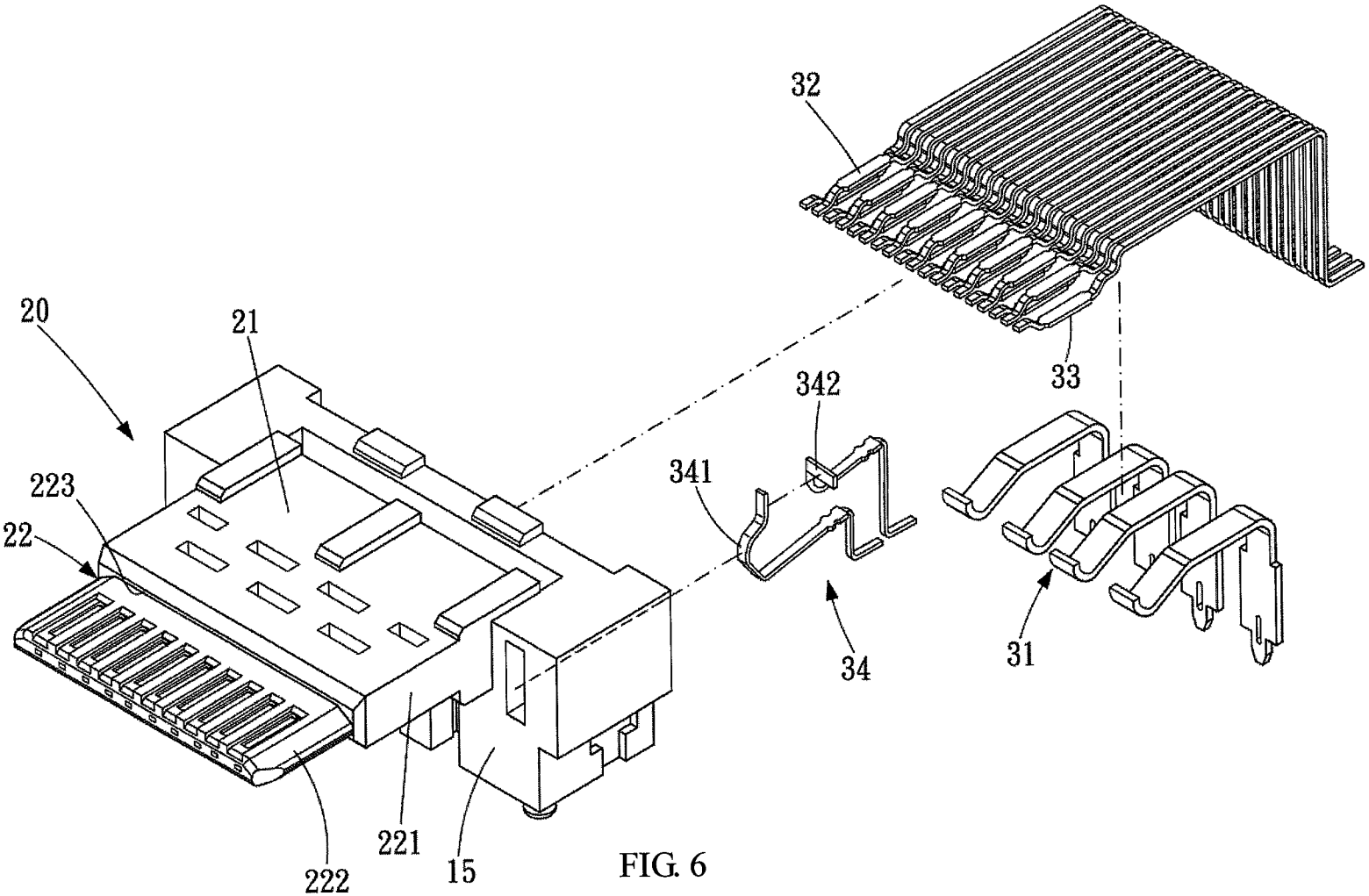
FIG. 6 is a schematic exploded view of the second embodiment.
Figure 7:
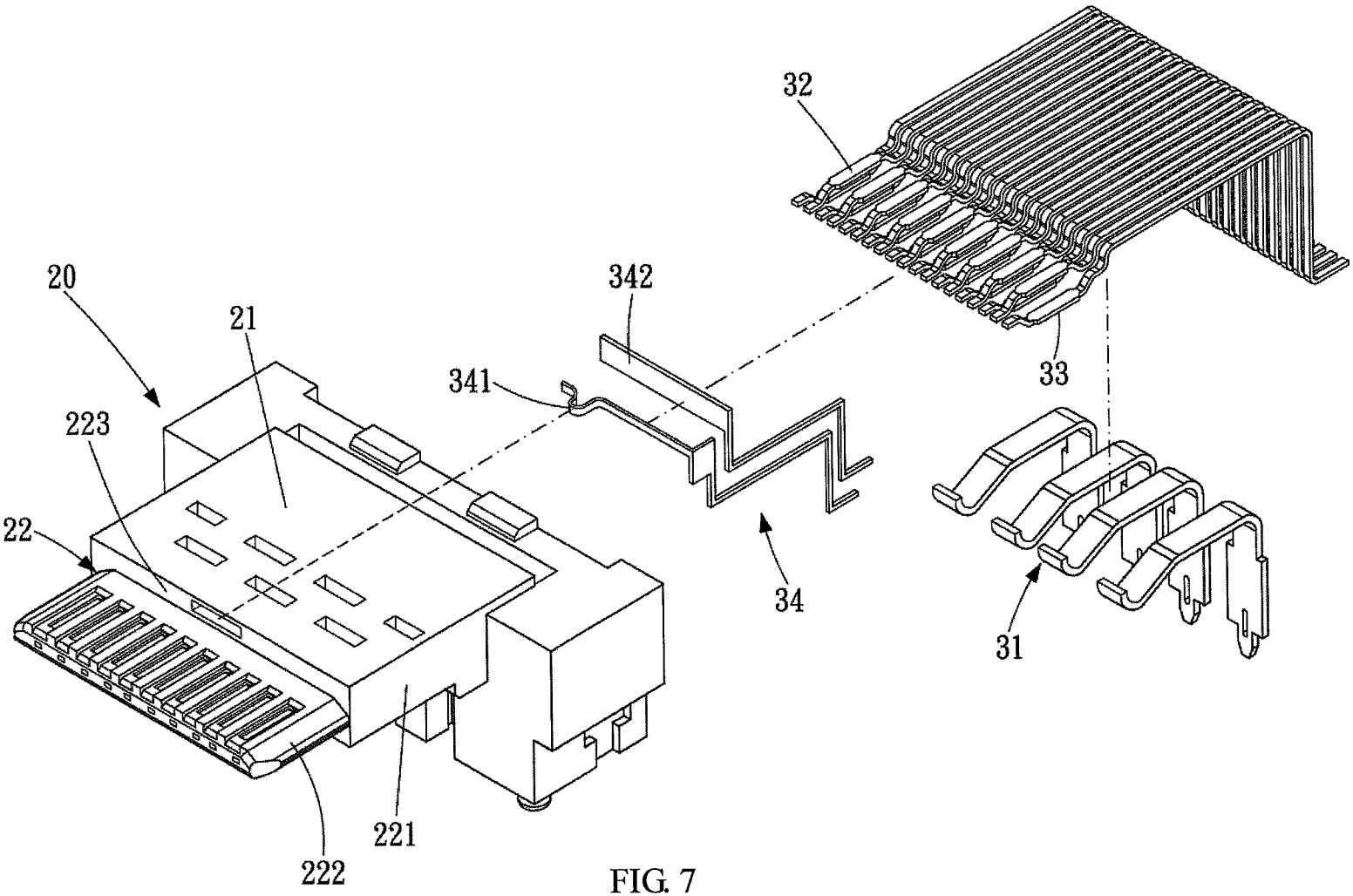
FIG. 7 is a schematic exploded view of the third embodiment.

Switch terminal 34 is disposed at abutment area 12 of main body 110 and used to be connected with connector plug 200. In this embodiment, switch terminal 34 is composed of two members, which are disposed at two side of insulating base 20 respectively (as shown in FIG. 6 and FIG. 7). Switch terminal 31 includes a moveable portion 341 and an abutment portion 342. Moveable portion 341 is pushed by connector plug 200 so as to connect electrically to abutment portion 342.

The number of first socket terminals 31 is configured to meet the first standard so as to transmit the first signal meeting the first standard (ex. USB), and connect to a first connector plug 200 meeting the first standard. The number of second socket terminals 32 is configured to meet the second standard so as to transmit the second signal meeting the second standard (ex. HDMI), and connect to a second connector plug 200 meeting the second standard. First socket terminals 31 and part of third socket terminals 33 transmit a third signal meeting the third standard and connect to a third connector plug 200 meeting the third standard. However, one skilled in the art is able to alter the number of terminals to transmit additional kinds of signals.

Figure 4:
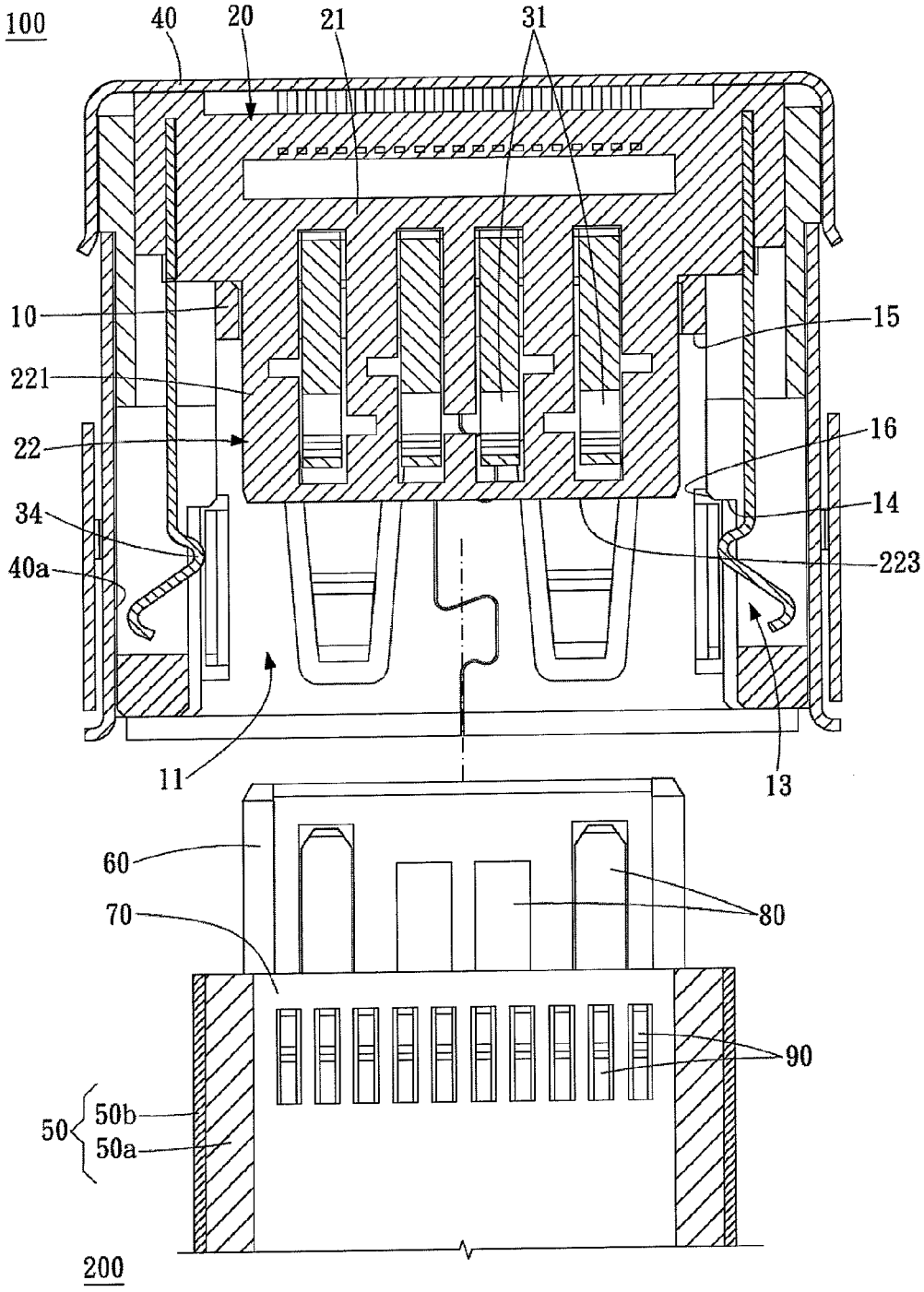
FIG. 4 is a schematic cross-sectional view (1) of the first embodiment connected with a plug alone the cross-section line A-A' in FIG. 1.
Figure 5:
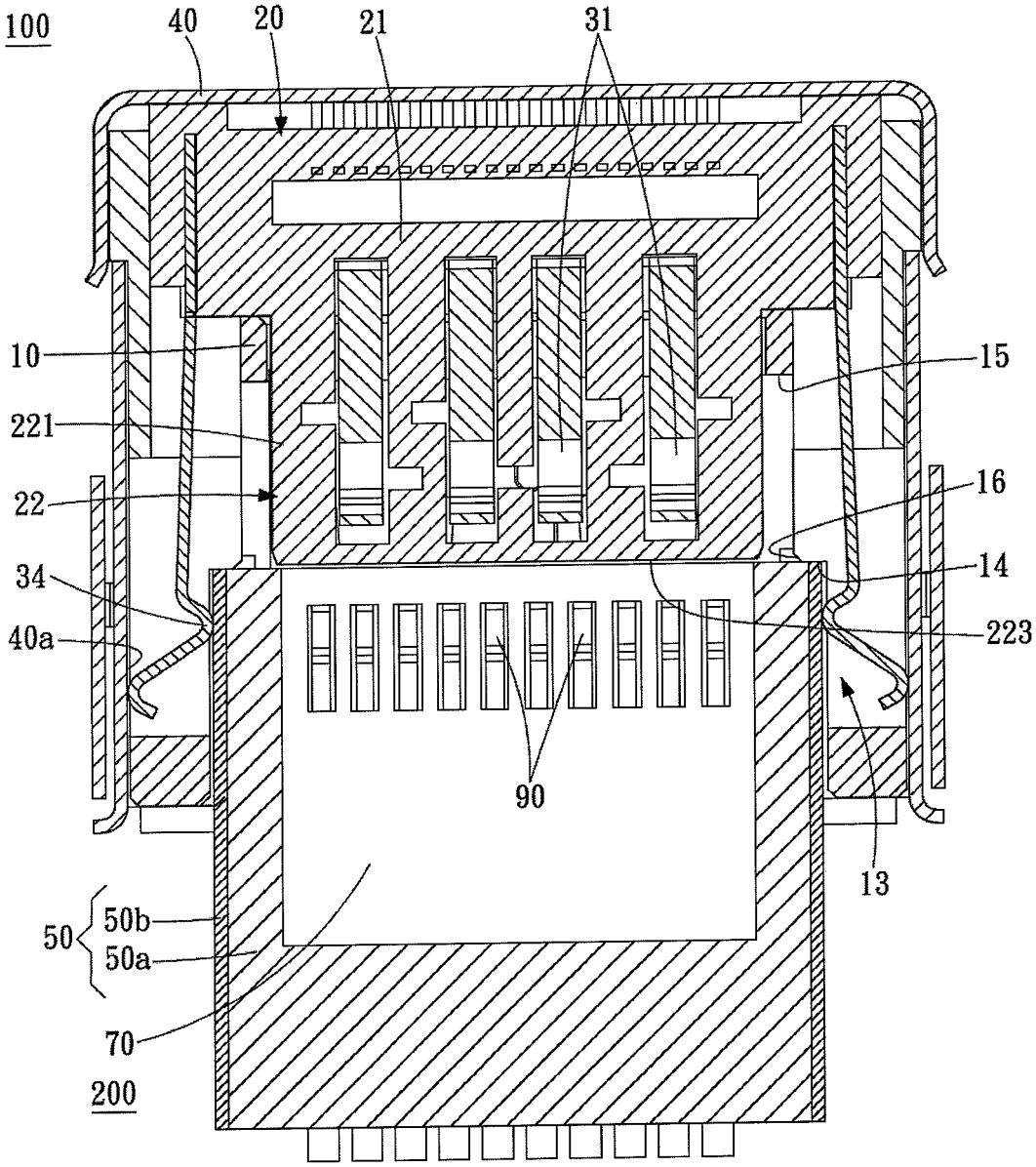
FIG. 5 is a schematic cross-sectional view (2) of the first embodiment connected with a plug alone the cross-section line A-A' in FIG. 1.

Please refer to FIG. 8, in which in the fourth embodiment, shell 40 is not included. Please refer to FIG. 6, in which insulating base 20 has shell 40 in the second embodiment. Shell 40 has a structure as first insert space 11 and second insert space 12 of plastic frame base 10 such that plastic frame base 10 is not required. As shown in FIG. 4 and FIG. 5, side surface 40*a* is capable of being contact by switch terminal 34. Switch terminals 34 elastically contact side shell 50*b* (as shown in FIG. 4 and FIG. 5), of connector plug 200 and side surface 40*a* of shell 40 of connector socket 100. Switch terminals 34 can transmit the signals to the outer electric circuit board and the control chip thereon so as to process signals such as switching transmitting pattern between the first signal and the second signal, or acting as detection pins.

Figure 3:
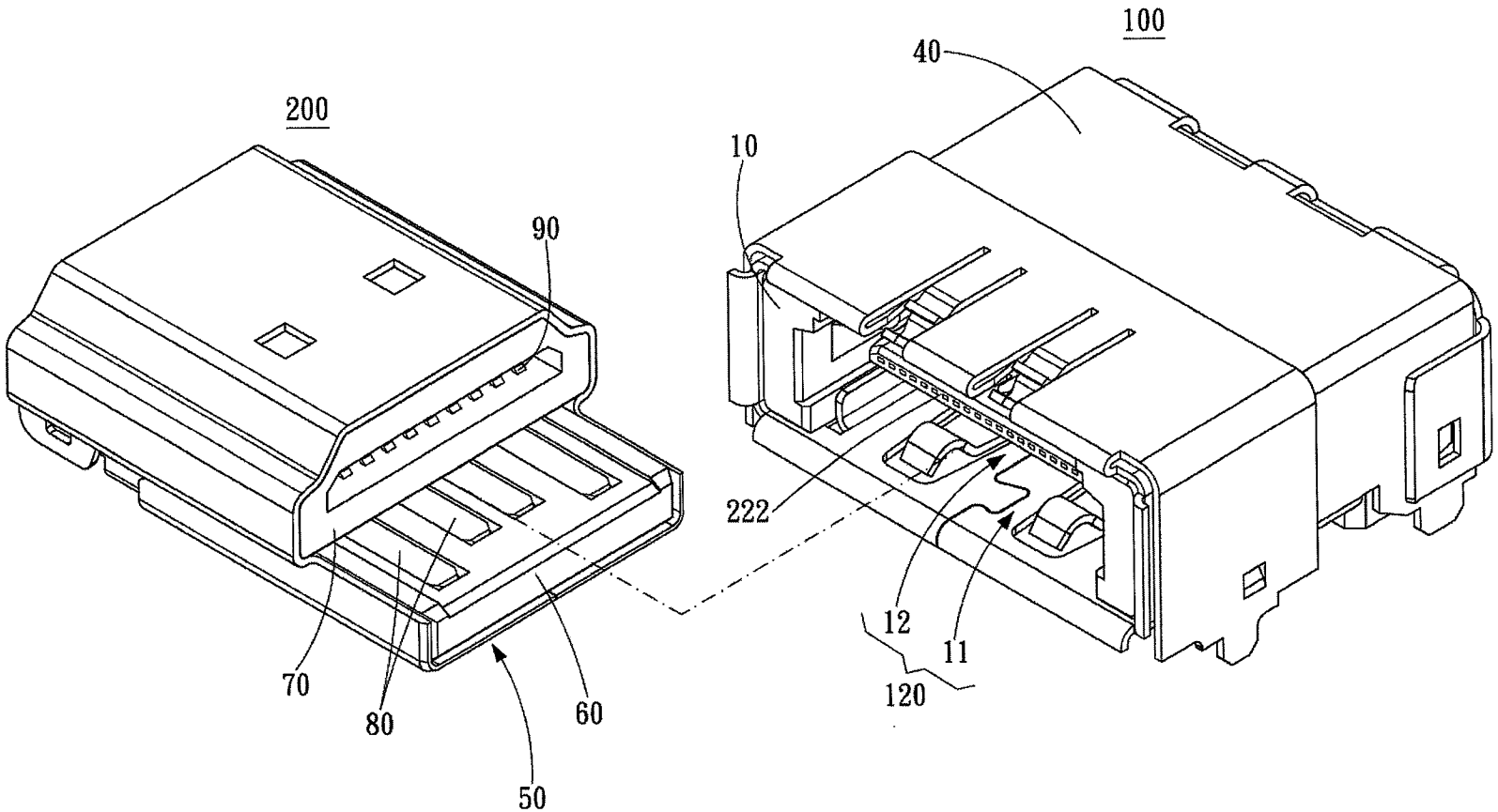
FIG. 3 is a schematic three-dimensional view of the first embodiment connected with a plug.

Please refer to FIG. 3, FIG. 4, and FIG. 5, which are embodiments of connector socket 100 and connector plug 200. Connector plug 200 is used to transmit the first signal and second signal. As the previously mentioned third signal must be transmitted, the third plug terminals must be added to the connector plug 200 in this embodiment. Connector 200 includes a main body 50, first insert portion 60, second insert portion 70, a plurality of first plug terminals 80, and a plurality of plug terminals 90.

Main body 50 includes an insulating base 50*a* and shell 50*b*. First insert portion 60 connects to main body 50. First insert portion 60 meets the first standard so that is capable of being inserted into first insert space 11. Second insert portion 70 connects to main body 50. Second insert portion 70 meets the second standard so that is capable of being inserted into second insert space 12. First socket terminals 80 are disposed at first insert portion 60. Part of second plug terminals 90 are disposed at first insert portion 60, and the other part of second plug terminals 90 are disposed at second insert portion 70 and facing first plug terminals 80 located at first insert portion 60.

As connector socket 100 connects to connector plug 200, first insert portion 60 inserts into first insert space 11 and contact first socket terminals 31 so as to transmit the first signal of the first standard. As first insert portion 60 and second insert portion 70 insert into first insert space 11 and second insert space 12, third socket terminals are contacted and transmit the second signal meeting the second standard.

It should noted that the shape of first insert portion 60 of electric connector plug 200 corresponds to the shape of first insert space 11 of electric connector socket 100 in the first embodiment. If the positions of first insert space 11 and second insert space 12 in the first embodiment are exchanged, then the positions of first insert portion 60 and second insert portion 70 in this embodiment are exchanged correspondingly.

Please refer to FIG. 6, which is a schematic exploded view of second embodiment. The primary difference that the embodiment differs from the first embodiment is that second abutment surface 15 is located at the surface of base 21 of insulating base 20 and with a through hole. Moveable portion 341 of switch terminal 34 is exposed by the through hole.

Please refer to FIG. 7, which is a schematic exploded view of the third embodiment. The primary difference that the embodiment differs from the second embodiment is that a step 223 is formed between first tongue portion 221 and second tongue portion 222. This means that first tongue portion 221 can be located at the upper, central, or lower position of second tongue portion if it is viewed from the inlet of connector socket. Step 223 is used to provide a place where switch terminal 34 is disposed at.

Please refer to FIG. 8, which is a schematic exploded view of the fourth embodiment. The abutment surface 14 has a through hole. Moveable portion 341 of switch terminal 34 is exposed by the through hole so as to be pushed as connector plug 200 is inserted into connector socket 100.

Please refer to FIG. 9, FIG. 10, FIG. 11, and FIG. 12, which are an schematic exploded view, back view, side cross-sectional view, and front-cross-sectional view of the fifth embodiment.

Figure 10:
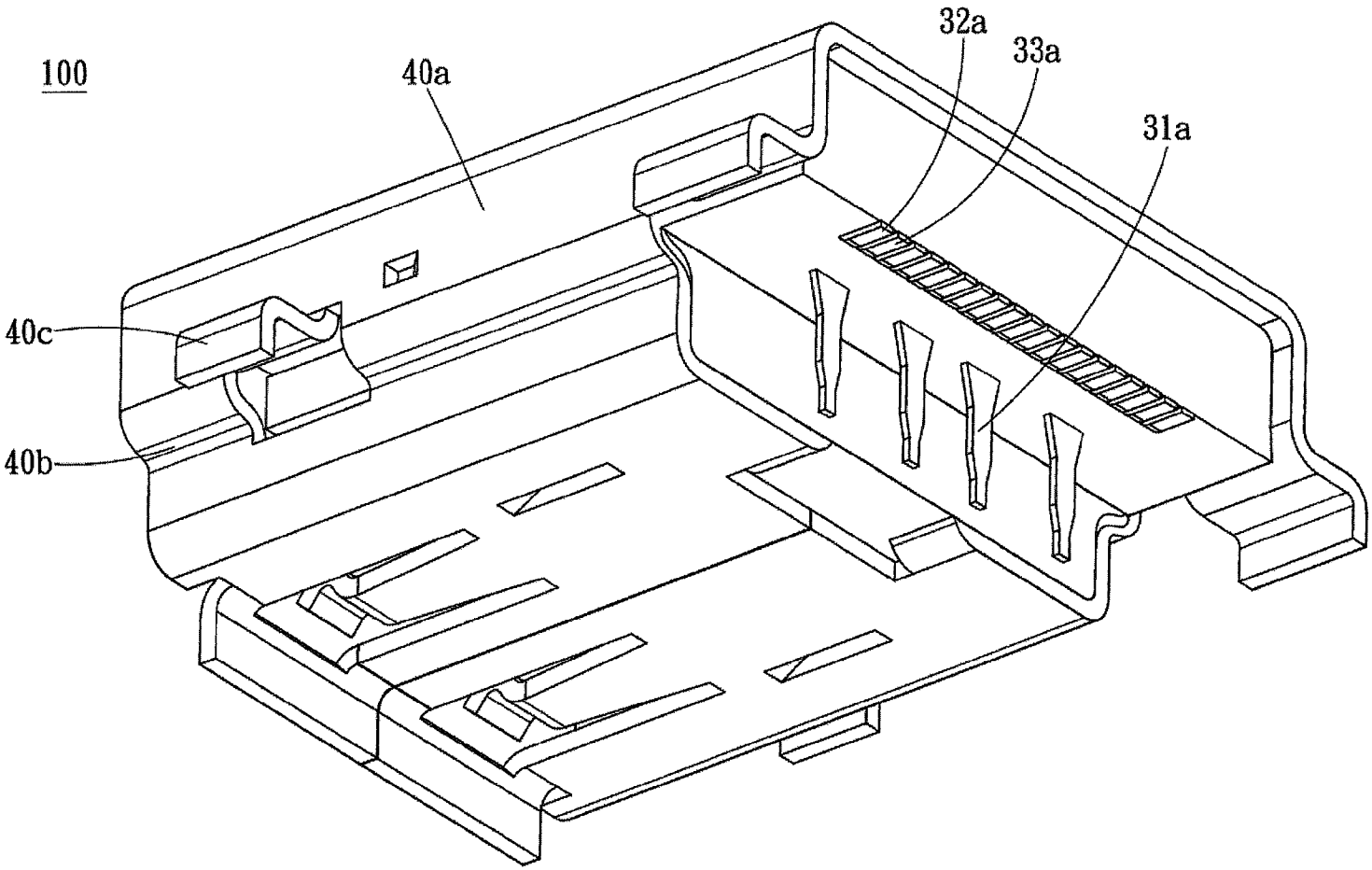
FIG. 10 is a schematic back view of the fifth embodiment.
Figure 11:
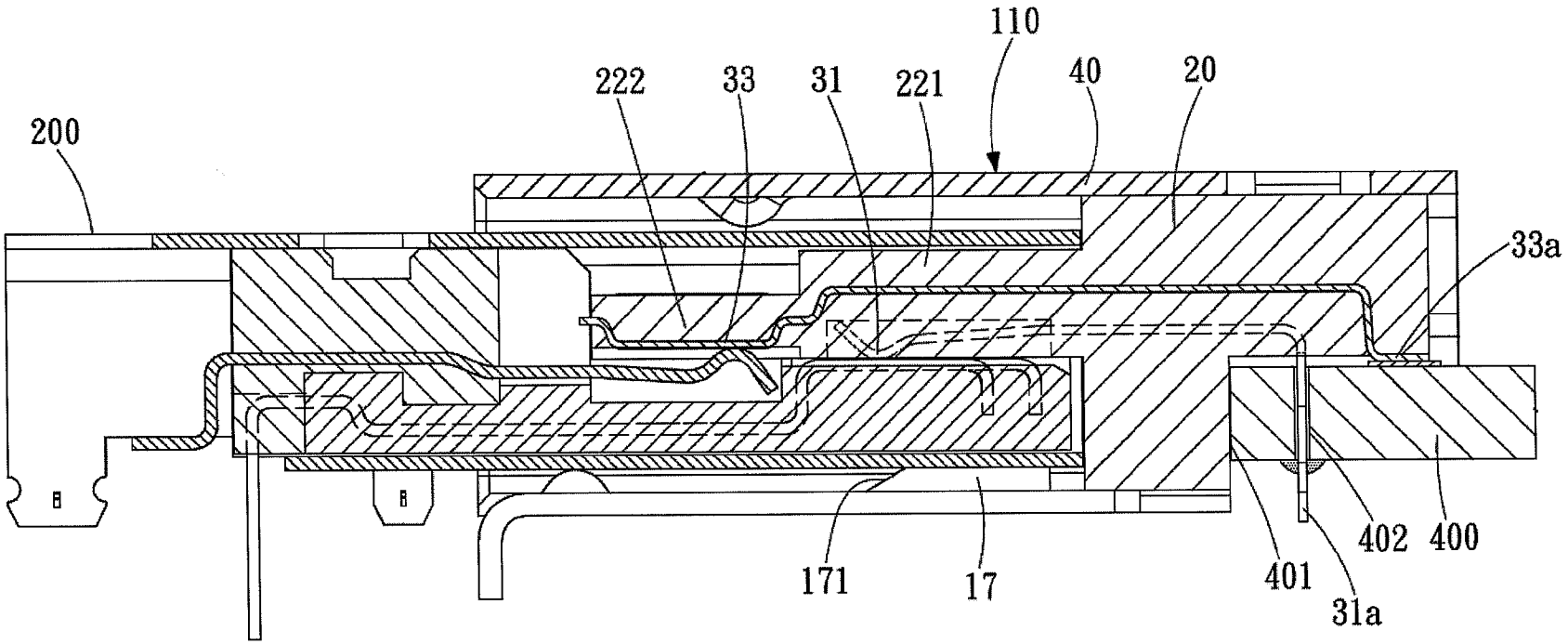
FIG. 11 is a schematic side-cross-sectional view of one embodiment connected with a plug.
Figure 12:
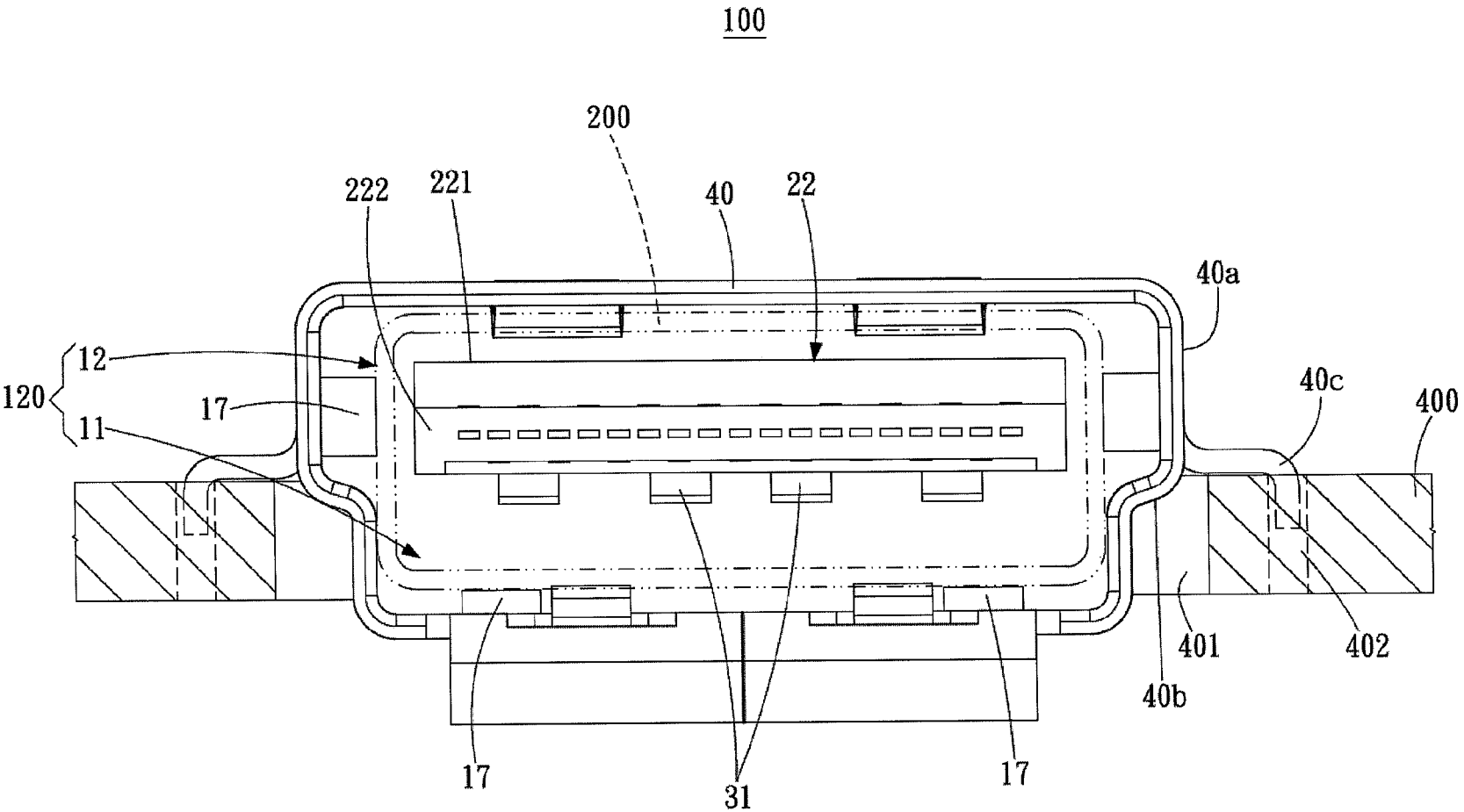
FIG. 12 is a schematic front-cross-sectional view of one embodiment connected with a plug.

In this embodiment, electric connector plug 100 is a sinking electric connector 100. Socket 120 includes position-limiting blocks 17, disposed at inner side of socket 120, and including guiding faces 171. As connector plug 200 meeting the first standard or the third standard inserts into first insert portion 11, guiding faces 171 guide it to be positioned (as shown in FIG. 11). Shell 40 is manufactured from a metal conducting material. Shell 40 includes socket 120, side surfaces 40*a*, and pins 40*c*. Side surfaces 40*a* having bending sections 40*b* are located at both sides of socket 120. Bending sections 40*b* are disposed at between first insert portion 11 and second insert portion 12. Pins 40*c* are disposed at bending sections 40*b* of side surfaces 40*a*. Pins are bent to form continuously bending pins 40*c* (as shown in FIG. 10), as well as mounted on circuit board 400 in the manner of DIP (Dual In-line Package). Preferably, pins 40*c* connect to external circuit board 400 and provide a sinking connection. This means that holes 401 are formed at one side of electric circuit board 400 for positioning connector socket 100 such that connector socket 100 is hung in the hole 401 (as shown in FIG. 12). The pins 40*c* connect to join points 402 on electric circuit board 400 by welding or by other methods.

In addition, one end of first socket terminals 31 includes first joint pins 31*a*, one end of second socket terminals 32 includes second joint pins 32*a*, and one end of third socket terminals 33 includes third joint pins 33*a*. Joint pins 31*a*, 32*a*, and 33*a* are exposed on insulating base 20. First joint pins 31*a* are disposed in front of second joint pins 32*a*. Second joint pins 32*a* are disposed at the same level with third joint pins 33*a* (as shown in FIG. 10). However, first joint pins 31*a*, second joint pins 32*a*, and third joint pins 33*a* are not limited to these embodiments. For example, first joint pins 21 are disposed in front of second joint pins 32*a*, and second joint pins 32*a* are disposed in front of third joint pins 33*a*. In another example, first joint pins 31*a*, second joint pins 32*a*, and third joint pins 33*a* are disposed at the same level. Furthermore, first joint pins 31*a*, second joint pins 32*a*, and third joint pins 33*a* are welded on the circuit board 400 in the manner of DIP (Dual In-line Package), or SMT (Surface Mounted Tech).

The embodiments provide a switch terminal disposed at the abutment area in the socket. The switch terminal is used to switch the transmission pattern between the first signal, the second signal, and the third signal. In another embodiment, the switch terminal is used to act as a detection pin for detecting which type of connector plug is inserted. One aspect of the present invention is to provide a first tongue portion connecting to a second tongue portion which has different thickness with the first tongue portion.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electric connector having multi-transmission interfaces, comprising:

a main body, comprising:

a socket;

a base, disposed in the socket;

a tongue, disposed in the socket and connecting to the base, the tongue comprises a first tongue portion and a second tongue portion, the first tongue portion has a first thickness and the second tongue portion has a second thickness different from the first thickness, the tongue defines the socket as a first insert space meeting a first standard and a second insert space meeting a second standard;

a plurality of first socket terminals, disposed at one side of the first tongue portion and transmitting first signal meeting the first standard;

a plurality of second socket terminals, disposed at a first surface of the second tongue portion; and a plurality of third socket terminals, disposed at a second surface of the second tongue portion; wherein the second socket terminals and the third socket terminals transmit a second signal meeting the second standard.

2. The electric connector according to claim 1, wherein the main body further comprises:

a first abutment surface, located at the inner wall of the socket, the first abutment surface retains a plug meeting the first standard; and a second abutment surface, located at the inner wall of the socket, the second abutment surface retains a plug meeting the second standard.

3. The electric connector according to claim 2, further comprising an abutment area disposed at the first abutment surface and configured to be disposed with a switch terminal.

4. The electric connector according to claim 2, further comprising an abutment area, disposed at the second abutment surface and configured to be disposed with a switch terminal.

5. The electric connector according to claim 1, wherein a step is formed between the first tongue portion and the second tongue portion, the step is configured to be disposed with a switch terminal.

6. The electric connector according to claim 1, further comprising a plurality of position-limiting blocks, disposed at the inner side of the socket, the position-limiting blocks limit the position of a first plug meeting the first standard or limit the position of a second plug meeting the second standard.

7. The electric connector according to claim 1, wherein the first socket terminals comprise a plurality of first pins, the second socket terminals comprise a plurality of second pins, the third socket terminals comprise a plurality of third pins; the first pins, the second pins, and the third pins are exposed on the insulating base.

8. The electric connector according to claim 1, wherein the main body further comprises a plurality pins, disposed at the both sides of the socket; the pins connect to an external electric circuit board and provide a function of sinking connection.

9. An electric connector having multi-transmission interfaces, comprising:

a main body, comprising:

a socket;

a base, disposed in the socket;

a tongue, disposed in the socket and connecting to the base, the tongue comprises a first tongue portion and a second tongue portion; the first tongue portion has a first thickness, and the second tongue portion has a second thickness different from the first thickness, the tongue defines the socket as a first insert space meeting a first standard and a second insert space meeting a second standard;

a plurality of first socket terminals, disposed at one side of the first tongue portion and transmitting a first signal meeting the first standard;

a plurality of second socket terminals, disposed at a first surface of the second tongue portion; and a plurality of third socket terminals, disposed at a second surface of the second tongue portion; the second socket terminals and the third socket terminals transmit a second signal meeting the second standard; the first socket terminals and part of the third socket terminals transmit a third signal meeting the third standard.

* * * * *